US006974041B2

(12) United States Patent
Salemi

(10) Patent No.: US 6,974,041 B2
(45) Date of Patent: Dec. 13, 2005

(54) ARTICLE STOWAGE SYSTEM

(76) Inventor: Leonard E. Salemi, 5 N. 330 Swift Rd., Itasca, IL (US) 60143

( * ) Notice: Subject to any disclaimer, the term of this patent is extended or adjusted under 35 U.S.C. 154(b) by 63 days.

(21) Appl. No.: 10/821,523

(22) Filed: Apr. 9, 2004

(65) Prior Publication Data

US 2005/0224430 A1 Oct. 13, 2005

(51) Int. Cl.[7] ..... A47B 65/00
(52) U.S. Cl. ..... 211/43; 211/184
(58) Field of Search ..... 211/43, 184, 59.3, 211/11, 42; 108/60, 61; 248/448, 441.1

(56) References Cited

U.S. PATENT DOCUMENTS

| | | | | |
|---|---|---|---|---|
| 527,897 | A | 10/1894 | Stikeman | |
| 583,494 | A | 6/1897 | Lundberg | |
| 1,237,101 | A | 8/1917 | Ryan | |
| 1,336,981 | A | 4/1920 | Schimmel | |
| 1,358,853 | A * | 11/1920 | Hruska | 211/43 |
| 1,674,582 | A | 6/1928 | Wheeler | |
| 2,140,656 | A | 12/1938 | Smith | |
| 2,206,133 | A | 7/1940 | Stoll | |
| 2,684,765 | A | 7/1954 | Lowenstein, Jr. | |
| 2,911,103 | A | 11/1959 | Kunkler | |
| 3,142,384 | A * | 7/1964 | Fridolph | 211/43 |
| 3,318,454 | A | 5/1967 | Donlin | |
| 3,487,945 | A | 1/1970 | Barham | |
| 3,513,983 | A | 5/1970 | Kellogg | |
| 3,747,775 | A | 7/1973 | Merola | |
| 4,113,108 | A | 9/1978 | Anderson | |
| 4,682,696 | A | 7/1987 | Shew | |
| 5,205,420 | A | 4/1993 | Petryszak | |
| 5,325,792 | A | 7/1994 | Mulloy | |
| 5,740,926 | A | 4/1998 | Mulloy | |
| 6,227,513 | B1 | 5/2001 | Richard | |

* cited by examiner

*Primary Examiner*—Jennifer E. Novosad
(74) *Attorney, Agent, or Firm*—Meroni & Meroni, PC; Christopher J. Scott; Charles F. Meroni, Jr.

(57) ABSTRACT

A bookend-like stowage system comprises at least one slide support assembly receivable in an assembly-receiving slot. The assembly-receiving slot comprises first and second substantially parallel spring member-engaging surfaces oriented orthogonal to the assembly-receiving slot, and a slide member-receiving portion formed adjacent the spring member-engaging surfaces. The slide support assembly comprises an article-engaging upright, a slide member, and a V-shaped spring member. The slide member is slidably received in the slide member-receiving portion and the spring member is received in a spring member-receiving groove formed in the slide member. The terminal ends of the spring member are oriented orthogonal to the assembly-receiving slot and cooperatively associated with the spring member-engaging surfaces for allowing unidirectional movement of the slide support assembly when in one equilibrium position and for allowing bidirectional movement of the slide support assembly when in a further equilibrium position.

21 Claims, 6 Drawing Sheets

ARTICLE STOWAGE SYSTEM

BACKGROUND OF THE INVENTION

1. Field of the Invention

The present invention generally relates to a system for, stowing, holding or maintaining articles in juxtaposed or side-by-side relation. More particularly, the present invention relates to a system for maintaining substantially flat articles in juxtaposed relation as a means to organize and stow the articles. The substantially flat articles may comprise various types of items, such as container lids, books, playing cards, compact disk cassettes, napkins, envelopes, and other articles readily subject to organization and stowage by book end-type structure.

2. Description of the Prior Art

The prior art dealing with or specifying book end-type structure is old and well-developed. Public and private libraries the world over regularly utilize some type of book end device or system to prop or support a row of books. Often, the need arises to stow or organize other types of substantially flat article structures in a fashion similar to the familiar book end type support system. One such example well noted by the author of this writing is the need to store or organize the numerous types of container lids found in a typical household kitchen. In order to properly stow and/or organize flat articles such as container lids in juxtaposed relation, it is often necessary to incorporate some selective locking means to enable the user to lock the prop or support structure in place adjacent the terminal article of a given row of articles. The prior art does teach several types of book end-type systems designed to provide selectively lockable or adjustable props or supports for maintaining substantially flat articles in juxtaposed relation. Several of these prior art disclosures that do teach adjustable or lockable book end-type structures are described hereinafter.

U.S. Pat. No. 527,897 ('897 patent), which issued to Stikeman, discloses a Book Support. The '897 patent teaches a book support which is used in connection with a grooved or slotted shelf as referenced at A. The book support comprises a single piece of metal so shaped, bent and fashioned as to form a double-walled triangularly shaped abutment or brace as referenced at C. The abutment or brace C is formed with depending and outwardly bent flanges "c" and "c", which enter the groove "a" and bear against the side walls of the groove so as to sustain the support in any position to which it may be moved. When it is desired to adjust the support on the shelf, it is only necessary to grasp the brace portion with one hand and squeeze the side walls of the same together thus releasing the pressure of flanges on the side walls of the groove, and then move the support along the groove or slot in either direction. Upon releasing the brace portion the flanges will press against the side walls of the groove and hold the support firmly in position.

U.S. Pat. No. 2,684,765 ('765 patent), which issued to Lowenstein, discloses a Holder for Books and the Like. The '765 patent teaches holders for books and the like that is adjustable for accommodating and supporting in upright position a plurality of different sized books of different thickness. In relevant portion, the '765 patent teaches a spring 44 secured to the bookend and preferably the front wall thereof and has upwardly diverging portions 45 terminating in downwardly and outwardly extending portions 46 which terminate in upwardly curved portions 47 adapted to resiliently engage the upper surface 4 of the top wall 3 of the base. The resilient members tend to maintain the lugs 38 in engagement with the lower faces 29 of the ribs 27 and 28 to create frictional contact for resisting movement of the bookends relative to the base.

U.S. Pat. No. 4,113,108 ('108 patent), which issued to Anderson, discloses an Adjustable Book Holding Device. The '108 patent teaches a device adapted to support one or more groups of books, magazines, file folders, papers or the like in any desired spaced relation along an underlying panel which may be a shelf or tray. The device includes manually adjustable book supports adapted to bear against the outside books in each group. The book supports are longitudinally slidable and self locking to lateral pressure from the books.

U.S. Pat. No. 4,682,696 ('696 patent), which issued to Sheu, discloses an Adjustable Bookrack. The '696 patent teaches an adjustable bookrack comprising a base with a guideway provided in an upper surface thereof, the guideway having a first frictional surface; a stationary upright end wall mounted securely at one end of base; a movable upright end wall disposed detachably on the guideway; a gliding member secured to the underside of the movable upright end wall and slidable on the guideway; a braking member releasably disposed under the gliding member and having a second frictional surface opposing the first frictional surface; and means for biasing the braking member toward the gliding member so as to impel the second frictional surface against the first frictional surface, including an actuator member. Thereby, when the actuator member is pushed, the braking member is released from the guideway so as to adjust the space between the stationary and movable upright end wall.

It will thus be noted that the prior art teaches a variety of mechanisms for allowing users to selectively adjust and lock book end-type uprights for stowing or organizing books and the like intermediate the book end-type uprights. Further, the prior, art teaches a number of slotted surfaces for receiving various types of selectively lockable book end-type uprights. From a thorough inspection of the prior art, it will be seen, however, that none of the prior art disclosures teach an article stowage system comprising, in combination, an assembly-receiving base having a wedge or dovetail shaped slot, and a slide support assembly receivable in the base, which assembly comprises, in combination, an upright support member fixedly and orthogonally attached to a slide member, which slide member comprises a rounded superior slide surface for tangential contact with opposing superior slot surfaces. Further, the prior art does not teach a slide support assembly comprising a V-shaped spring member held in pivotal contact with the upright at the spring member vertex, the terminal ends of which are oriented orthogonal to the slot track for lodged engagement with the track walls.

It is noted that the '897 patent does teach spring like means for selectively placing the book end uprights in frictionally locked engagement with a book end-receiving slot. However, it will be noted from a careful inspection of the '897 patent that the terminal ends of the spring like means are oriented parallel to the slot track. It is contemplated that given sufficient load force directed against the book end upright from the stowed article direction, that static (and kinetic) frictional forces between the slot walls and outwardly bent flanges "c" and "c" may be overcome, thus causing outwardly bent flanges "c" and "c", which enter the groove "a" and to accelerate in the direction of the friction-overcoming force. The prior art thus perceives a need for a slide support assembly comprising a V-shaped spring member, which terminal ends are orthogonally oriented relative to the slot track or groove so that when load forces are directed against the upright member from the direction of the stowed articles, the terminal spring ends, under expansive force, become lodged or embedded in the side walls (as the load force drives the terminal spring ends into the side walls) of the track or groove for preventing linear acceleration along the groove or slotted track.

It will thus be seen from a consideration of the above-referenced patents and other prior art generally known to exist, that the prior art does not teach an article stowage system comprising, in combination, an assembly-receiving base having a wedge or dovetail shaped slot, and a slide support assembly receivable in the base, which assembly further comprises, in combination, an upright support member fixedly and orthogonally attached to a slide member, which slide member comprises a rounded superior slide surface for tangential contact with opposing superior slot surfaces. Further, the prior art does not teach a slide support assembly comprising a V-shaped spring member held in pivotal contact with the upright at the vertex of the spring member. Further, the prior art does not teach a V-shaped spring member held in pivotal contact with an upright member, the terminal ends of which spring member are oriented orthogonal to the slot track for lodged engagement with the track walls.

The prior art thus perceives a need for a selectively lockable article stowage system comprising, in combination, an assembly-receiving base having a wedge-shaped slot formed therein for receiving an improved slide support assembly. In this last regard, the prior art further perceives a need for an improved slide support assembly comprising, in combination, an upright support member fixedly and orthogonally attached to a slide member, which slide member is received in the wedge-shaped slot such that the superior slot surfaces are in tangential slidable contact with the rounded superior surface of the slide member. Further, the prior art perceives a need for selective spring locking means defined by a substantially V-shaped spring member, the terminal ends of which function to become lodged in the side walls of the assembly-receiving slot under the action of load forces directed against the upright member for preventing the slide support assembly from accelerating along the slot track.

SUMMARY OF THE INVENTION

Accordingly, it is an object of the present invention to provide an adjustable, lockable article stowage system for enabling users thereof to effectively stow articles intermediate book end-type prop supports or uprights. It is a further object of the present invention to provide an article stowage system comprising, in combination, an assembly-receiving base having a wedge or dovetail shaped slot, and a slide support assembly receivable in the base, which assembly comprises, in combination, an upright support member fixedly and orthogonally attached to a slide member, the slide member comprising a rounded superior slide surface for tangential contact with opposing superior slot surfaces. It is a further object of the present invention to provide a slide support assembly comprising a V-shaped spring member held in pivotal contact with the upright at the spring member vertex. It is a further object of the present invention to provide a V-shaped spring member, the terminal ends of which are oriented orthogonal to the slot track for lodged engagement with the track walls. Thus, it is a further object of the present invention to provide improved load force opposing structure for selectively preventing the upright support member from accelerating along the assembly-receiving slot. At the user's election, the terminal ends of the V-shaped spring member may be manually dislodged from lodged engagement with the slot walls for allowing the slide support assembly to be translated bidirectionally in the assembly-receiving slot.

To achieve these and other readily apparent objectives, the present invention provides an article stowage system for stowing substantially flat articles in vertically juxtaposed relation, the flat article stowage system comprising, in combination, slide support assembly-receiving means and at least one slide support assembly. The slide support assembly-receiving means essentially comprises a slide support assembly-receiving slot, which slide support assembly-receiving slot comprises first and second substantially parallel spring member-engaging surfaces, and a slide member-receiving portion formed adjacent the spring member-engaging surfaces. The slide member-receiving portion essentially comprises a slide member-engaging surface, which surface extend from the first spring member-engaging surface to the second spring member-engaging surface or comprises a laterally opposed superior slot surfaces and an inferior slot surface intermediate the superior slot surfaces.

Each slide support assembly essentially comprises an article-engaging upright, a slide member, a spring member, and component attachment means. The article-engaging upright essentially comprises an outer upright surface and an inner upright surface. The slide member essentially comprises an upright attachment end, a slide surface end, a slide surface, and a spring member-receiving groove intermediate the upright attachment end and the slide surface end. The spring member essentially comprises first and second spring ends and a spring body intermediate the first and second spring ends. The component attachment means fixedly attach the upright attachment end of the slide member to the article-engaging upright. Further, the component attachment means pivotally attach the spring body or vertex of the preferably V-shaped spring member to the outer upright surface of the article-engaging upright. The spring member is received in the spring member-receiving groove and the slide member is received in the slide member-receiving slot. The slot surface slidably contacts the slide surface and the spring ends contact the spring member-engaging surfaces for allowing the slide support assembly to translate unidirectionally given a driving force. Further, the spring member is compressible for eliminating contact between the spring ends and the spring member-engaging surfaces to allow the slide support assembly to translate bidirectionally given properly directed driving forces.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of my patent drawings, as follows.

DETAILED DESCRIPTION OF THE PREFERRED EMBODIMENT

Figure 10:
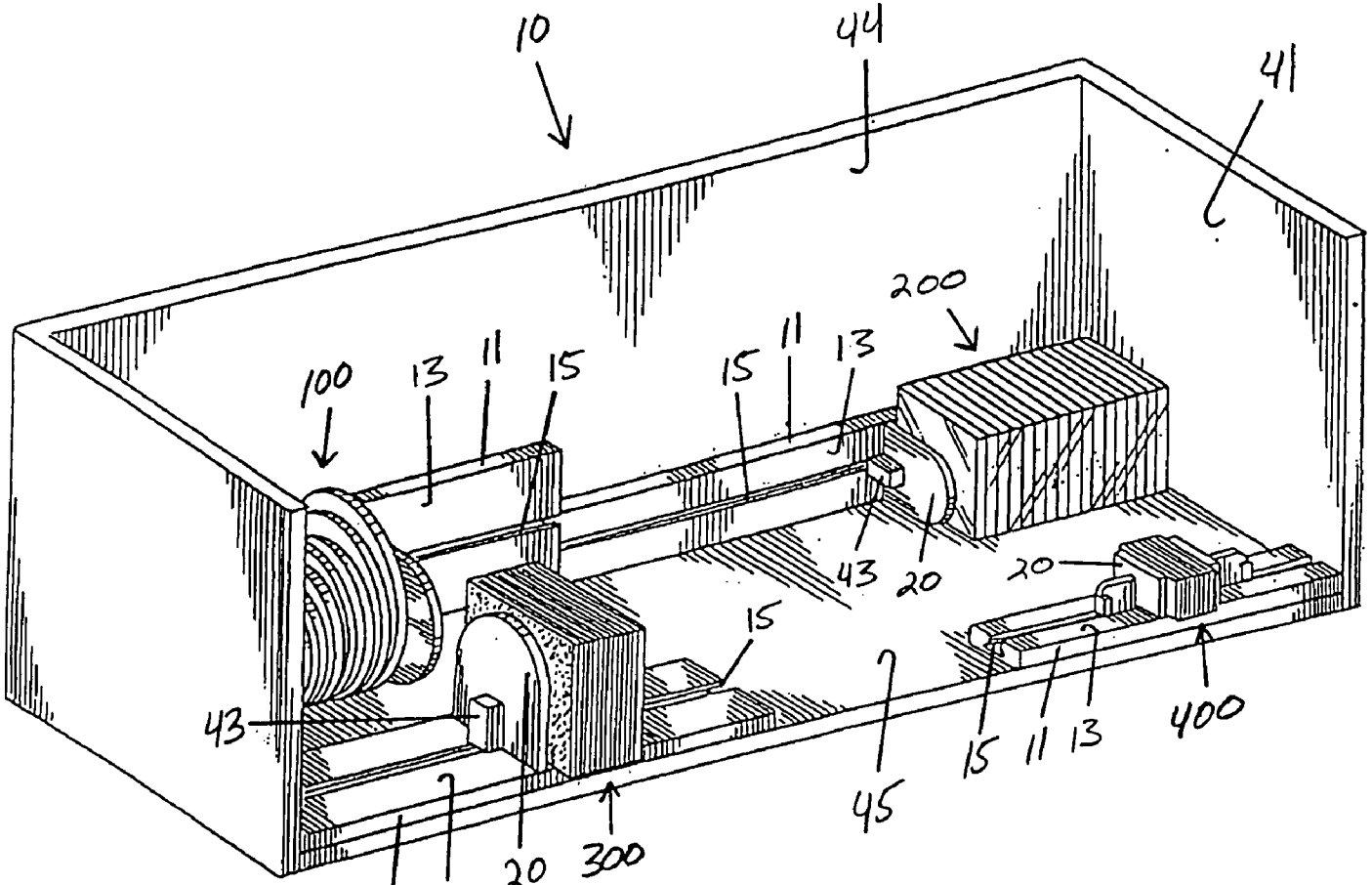
FIG. 10 is a perspective view of an article stowage system showing horizontally and vertically configured article stowage assemblies.
Figure 11:
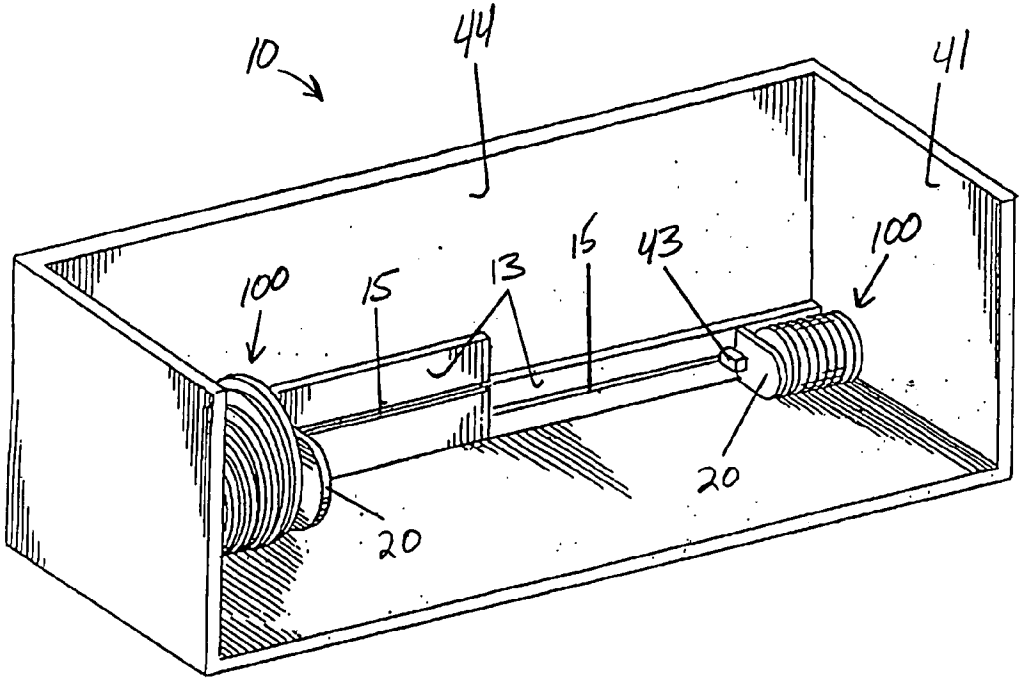
FIG. 11 is a perspective view of an article stowage system showing horizontally configured article stowage assemblies.
Figure 12:
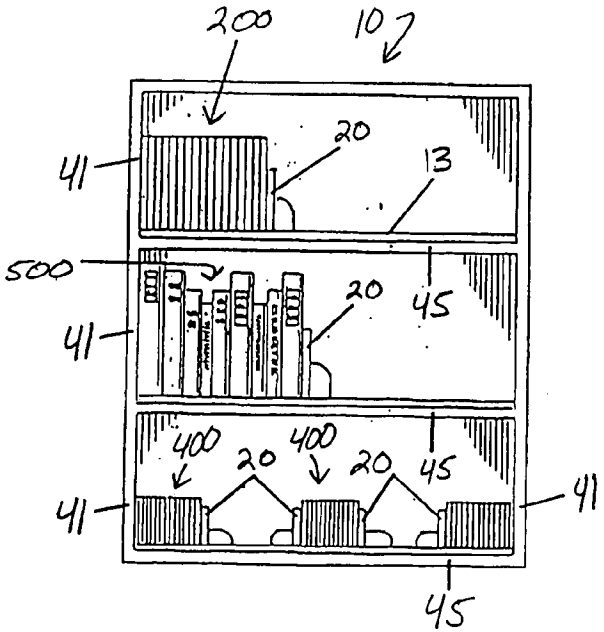
FIG. 12 is a front plan view of an article stowage system showing vertically configured article stowage assemblies.

Referring now to the drawings, the preferred embodiment of the present invention concerns an article stowage system or article stowage assembly much akin to a bookend assembly for stowing articles in juxtaposed relation. As earlier noted, however, the idea driving the present invention grew out of the question of how to store or organize the many container lids commonly found in a household kitchen. Thus, it is contemplated that the present invention concerns an article stowage system or article stowage assembly for stowing not only books and the like, but flat articles in general. In other words, not only does the present invention maintain books and the like in vertically juxtaposed relation, but also such common household items such as container lids, compact disk cassettes, napkins, mail envelopes, playing cards, etcetera. The article stowage system 10 or article stowage assembly has been generally illustrated in FIGS. 1, 10, 11, and 12. From an inspection of FIGS. 10–12, it will be seen that the present invention effectively stows container lids 100 as illustrated in FIGS. 10 and 11; compact disk cassettes 200 as illustrated in FIGS. 10 and 12; napkins 300 as illustrated in FIG. 10; and playing cards 400 as illustrated in FIGS. 10 and 12. FIG. 12 further illustrates article stowage system 10 effectively stowing books 500.

Article stowage system 10 preferably comprises, in combination, slide support assembly-receiving means or a slide support assembly-receiving base 11 as illustrated and referenced in FIGS. 1–7, and 10–12; at least one slide support assembly 12 as illustrated and referenced in FIGS. 1, 2, 8, and 9; and a substantially planar select support structure, described in more detail hereinafter. The slide support assembly-receiving means or slide support assembly-receiving base 11 is essentially a substantially planar piece of stock material such as press board, birch wood or poplar wood, which material preferably comprises a finished upright-engaging surface 13 as illustrated and referenced in FIGS. 1–7, and 10–12; a support-engaging surface 14 as referenced in FIGS. 1–3, and 7; and a substantially linear, assembly-receiving slot 15 as illustrated and referenced in FIGS. 1–7, 10, and 11.

Slide support assembly-receiving base 11 may be attached via any number of fastening means to a select support structure such as cabinetry or the like per the election of the user. In other words, the user may select a suitable site for stowing articles and then attach slide support assembly-receiving base 11 to the support structure such that support-engaging surface 14 is attached to the select support structure. FIGS. 10–12 generally illustrate possible sites for stowing articles and it will be understood from an inspection of the noted figures that support-engaging surface 14 is attached to the select support structure. It is contemplated that the fastening means may be defined by suitable adhesive type fastening means or mechanical hardware type fastening means, such as screws or nut/bolt assemblies. It is further contemplated that slide support assembly-receiving base 11 may be attached to either a vertical support structure 44 as illustrated and referenced in FIGS. 10 and 11 or a horizontal support structure 45 as illustrated and referenced in FIGS. 10 and 12.

As will be seen from an inspection of FIGS. 1–3, and 7, assembly-receiving slot 15 is preferably formed intermediate upright-engaging surface 13 and support-engaging surface 14. It is contemplated that assembly-receiving slot 15 may preferably be formed by routing out the material comprising slide support assembly-receiving base 11. In this regard, it is contemplated that material may be removed from slide support assembly-receiving base 11 such that assembly-receiving slot 15 comprises two opposite, substantially parallel spring member-engaging surfaces 16 as illustrated and referenced in FIGS. 3–7, and a slide member-receiving portion adjacent spring member-engaging surfaces 16. In other words, the slide member-receiving portion is preferably formed intermediate spring member-engaging surfaces 16 and support-engaging surface 14. It should be noted that spring member-engaging surfaces 16 have a certain "first distance" therebetween. The slide member-receiving portion preferably comprises a dovetail or wedge-shaped cross section as generally illustrated in FIGS. 1–3, and 7 and thus comprises a substantially planar inferior slot surface 17 as specifically illustrated and referenced in FIGS. 2, 3, and 7; and two opposite, superior slot surfaces 18 angled from inferior slot surface 17 to spring member-engaging surfaces 16 as further specifically illustrated and referenced in FIGS. 2, 3, and 7.

It will be understood from an inspection of FIGS. 1 and 10–12 that article stowage system 10 is functional as intended incorporating either one slide support assembly 12 (as generally illustrated in FIG. 10 stowing compact disk cassettes 200) or two opposite slide support assemblies 12 (as generally illustrated in FIG. 10 stowing napkins 300 and playing cards 400 and as generally illustrated in FIG. 12 stowing playing cards 400). Each slide support assembly 12 preferably comprises a substantially planar article-engaging upright 20 as illustrated and referenced in FIGS. 1–6, and 8–12; a substantially linear slide member 21 as illustrated and referenced in FIGS. 1–9; a substantially V-shaped spring member 22 as illustrated and referenced in FIGS. 1–8; spring member attachment means 23 as illustrated and referenced in FIGS. 2–8; and slide member attachment means 24 as illustrated and referenced in FIGS. 1, 8, and 9.

Figure 1:
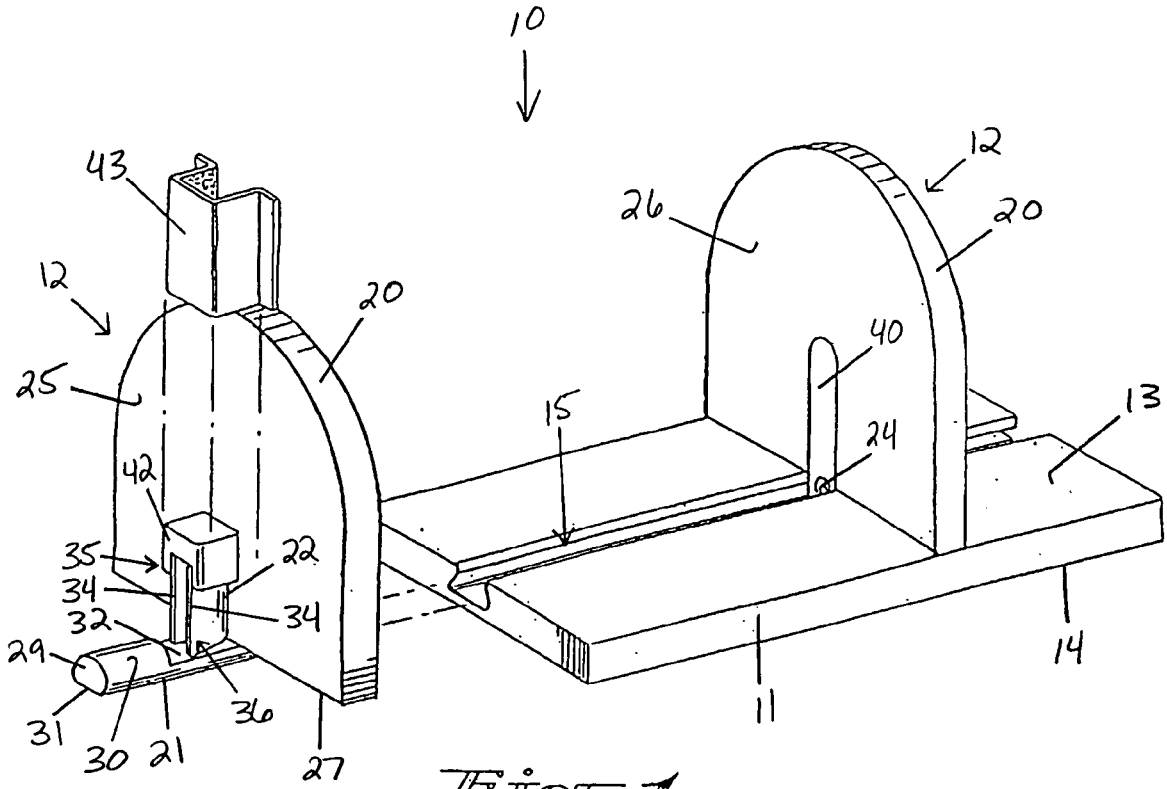
FIG. 1 is a perspective view of the preferred embodiment of the article stowage assembly showing a first slide support assembly removed from an assembly-receiving base and an opposing second slide support assembly inserted in the assembly-receiving base.
Figure 2:
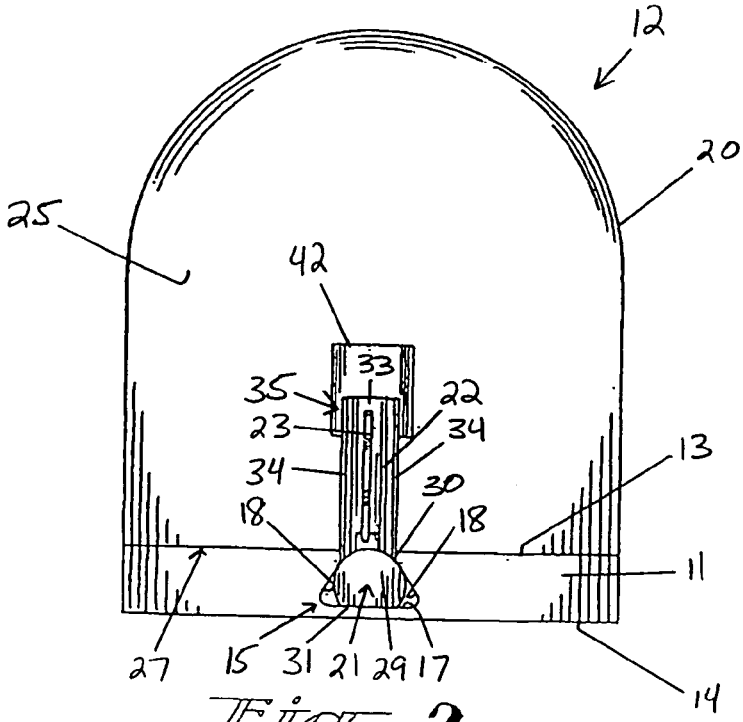
FIG. 2 is an outer end view of the preferred embodiment of the article stowage assembly with a slide support assembly received in an assembly-receiving base.
Figure 8:
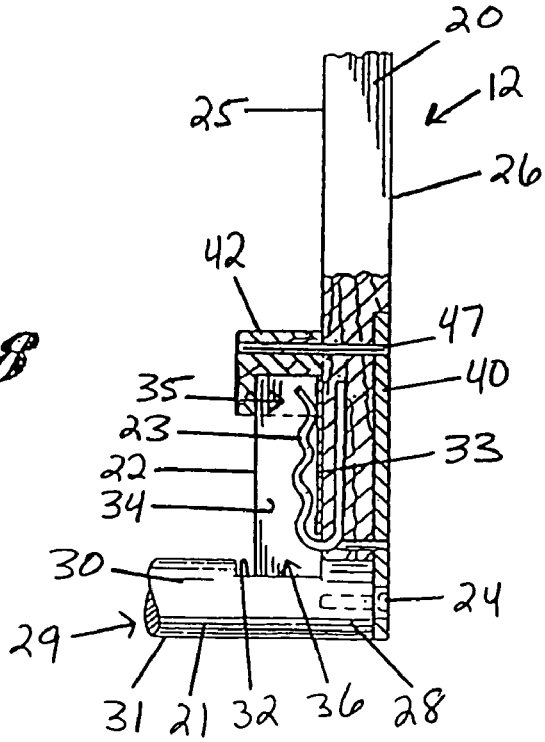
FIG. 8 is a fragmentary side view of a slide support assembly with parts removed to show spring member attachment means.
Figure 9:
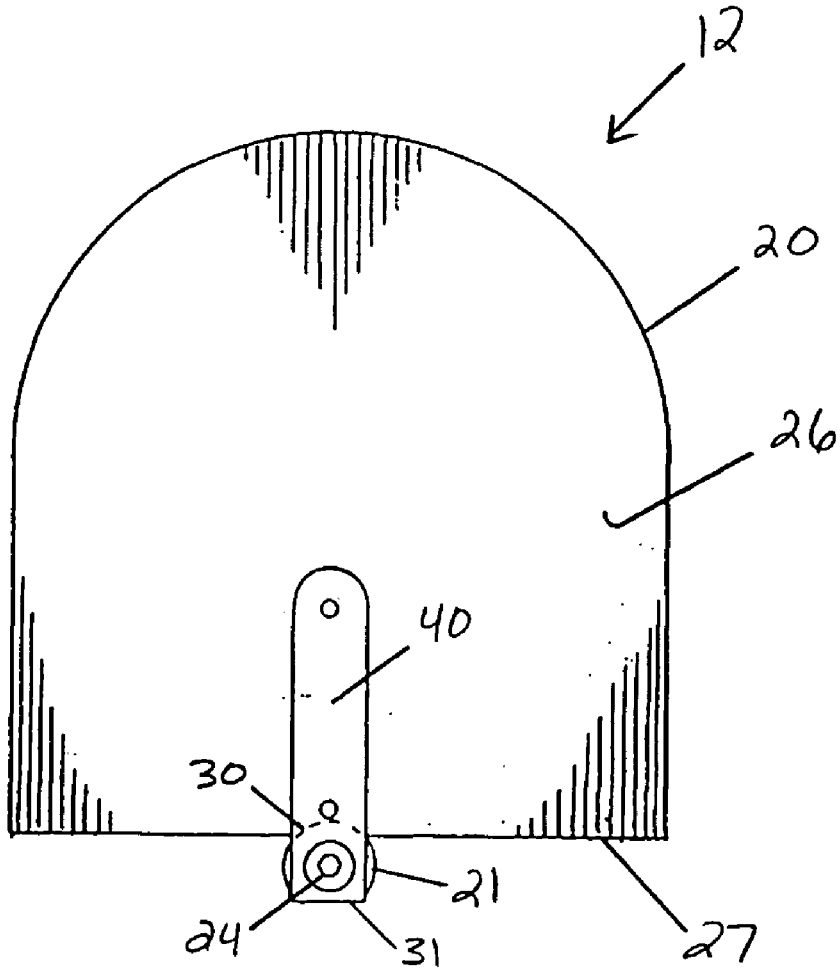
FIG. 9 is an inner end view of a slide support assembly.

Article-engaging upright 20 is preferably constructed from stock material such as a user-selected grade of wood (excellent results have been achieved using 0.5 inch thick poplar wood) and comprises an outer upright surface 25 as illustrated in FIGS. 1–6, and 8; an inner upright surface 26 as illustrated and referenced in FIGS. 1, 4–6, 8, and 9; and an inferior upright surface 27 as referenced in FIGS. 1, 2, and 9. Slide member 21 is preferably constructed from a 0.625 inch diameter cylindrical (free-machining grade) aluminum member and comprises an upright attachment end 28 as referenced in FIG. 8; a slide surface end 29 as illustrated and referenced in FIGS. 1–3, 7, and 8; a rounded superior slide surface 30 as illustrated and referenced in FIGS. 1–9; a substantially planar inferior slide surface 31 as illustrated and referenced in FIGS. 1–3, and 7–9; and a spring member-receiving groove 32 intermediate upright attachment end 28 and slide surface end 29 as illustrated and referenced in FIGS. 1, 4–6, and 8.

As indicated, slide member 21 is preferably formed from a 0.625 inch diameter cylindrical aluminum rod. Inferior slide surface 31 is formed by machining an arc length of about 1.05 radians from the cylinder. By removing an arc length of about 1.05 radians from the cylinder, the distance from inferior slide surface 31 to the superior most point of superior slide surface 30 (the total remaining thickness of assembly-receiving slot) is about 0.5 inches. The preferred distance between spring member-engaging surfaces 16 (the preferred "first distance") is about 0.510 inches. The preferred height or depth of each spring member-engaging surface 16 from upright-engaging surface 13 to each of the superior most portions of superior slot surfaces 18 is about 0.1305 inches. Superior slot surfaces 18 are each preferably radially tangent to superior slide surface 30 at points about 0.3125 inches from the effective center of the otherwise cylindrical member. Slide support assembly-receiving base 11 must therefore comprise a thickness of at least 0.5 inches so that assembly-receiving slot 15 may properly be formed therein.

Figure 3:
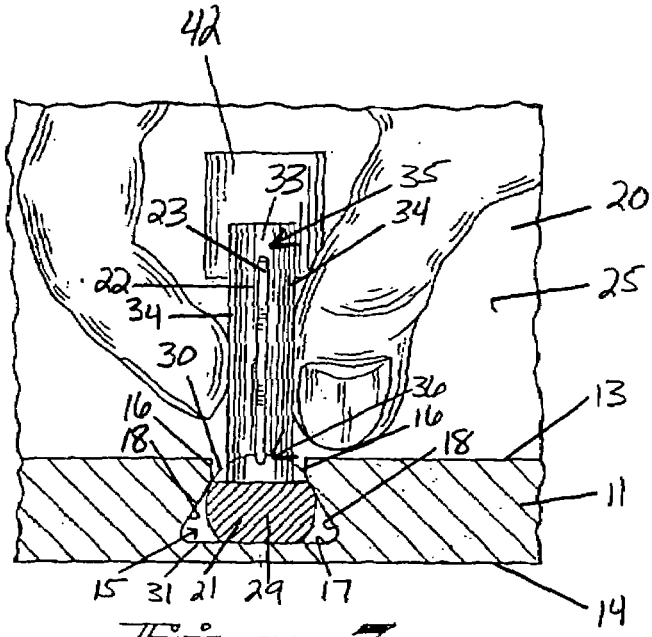
FIG. 3 is a fragmentary outer end view of a slide support assembly received in an assembly-receiving slot, showing a user compressing a spring member to a third equilibrium position.
Figure 4:
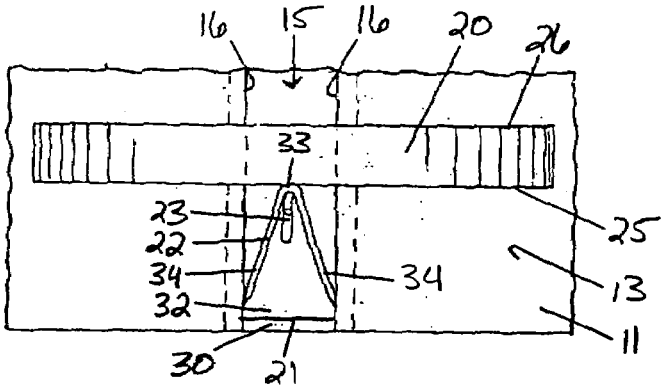
FIG. 4 is a fragmentary top plan view of a slide support assembly received in an assembly-receiving slot showing a spring member in a second equilibrium position.
Figure 5:
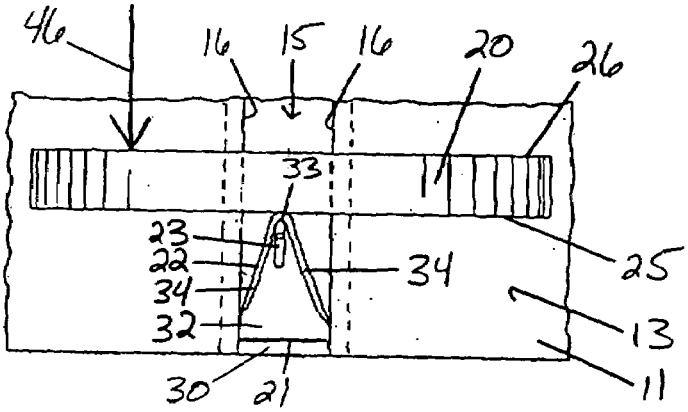
FIG. 5 is a fragmentary top plan view of a slide support assembly received in an assembly-receiving slot showing a spring member under exaggerated tension from a vector load force.
Figure 6:
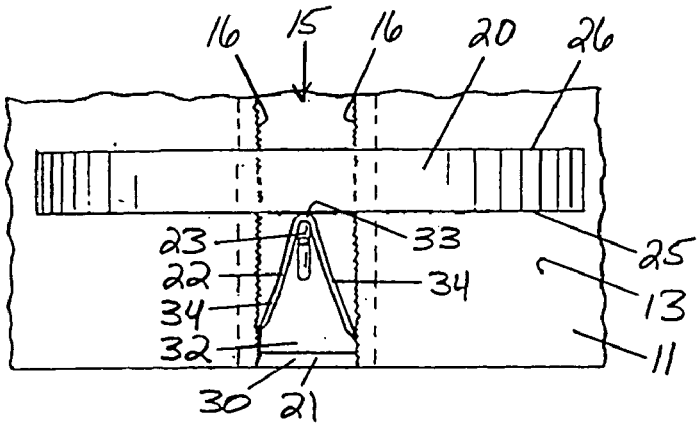
FIG. 6 is a fragmentary top plan view of a slide support assembly received in an assembly-receiving slot showing a spring member engaged with roughened spring member-engaging surfaces.
Figure 7:
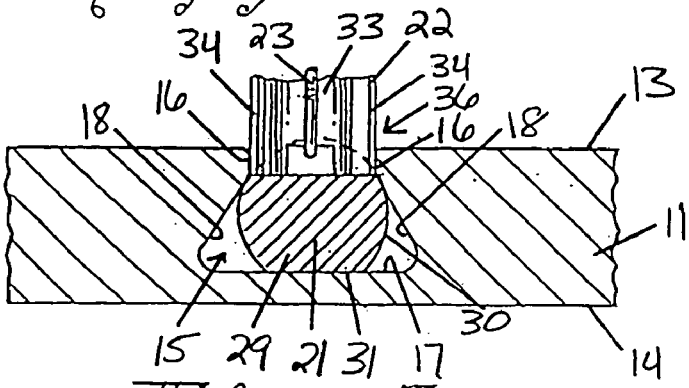
FIG. 7 is a fragmentary outer end view of a slide member inserted in an assembly-receiving slot showing an inferior spring region and slide member in tangential contact with superior slot surfaces.

The V-shaped spring member 22 is preferably constructed from spring steel and comprises a vertex region 33 as illustrated and referenced in FIGS. 2–8; two opposite spring wings 34 as illustrated and referenced in FIGS. 1–8; a superior spring region 35 as referenced in FIGS. 1–3, and 8; and an inferior spring region 36 as referenced in FIGS. 1, 3, 7, and 8. As will be understood from an inspection of the noted drawing figures, spring wings 34 extend from vertex region 33 and each preferably comprise a pointed or sharpened wing terminus or spring end as generally depicted in FIGS. 4–6 for enhancing unidirectional contact with spring member-engaging surfaces 16. It will be understood from a general inspection of FIG. 1 that the wing termini or spring ends have a "second distance" therebetween when spring member 22 is in a first equilibrium position, which first equilibrium position is generally illustrated in FIG. 1 in the leftmost slide support assembly 12.

The first equilibrium position of spring member 22 may preferably be defined by the "second distance" (the distance between wing termini) when slide support assembly 12 is removed from assembly-receiving slot 15. The "second distance" is thus preferably greater in magnitude than the "first distance" (the distance between spring member-engaging surfaces 16). Thus, the wing termini or spring ends of spring member 22, when in the first equilibrium position, are in a least compressed state. When slide support assembly 12 is inserted into assembly-receiving slot, the wing termini or spring ends of spring member 22 are in an intermediate compressed state defined as a second equilibrium state. The wing termini or spring ends thus make forceful contact with spring member-engaging surfaces 16 under the expansive forces of spring member 22 as spring member 22 attempts to return to the first equilibrium position. Thus, it will be seen that the wing termini or spring ends are in unidirectional or frictional contact with spring member-engaging surfaces 16.

For purposes of providing a more uniform first equilibrium position, it is contemplated that slide support assembly 12 may further preferably comprise spring member compression means. The spring member compression means may preferably be defined by a spring-compressing cap 42 as illustrated and referenced in FIGS. 1–3, and 8. Spring-compression cap 42 preferably comprises a spring-receiving notch and cap attachment means. Essentially, spring-receiving cap 42 is an upside down U-shaped member having a notch being defined by opposite notch walls. The notch walls are spaced so as to retain spring member 22 in the first equilibrium position. It will be seen from an inspection of FIGS. 1–3, and 8 that superior spring region 35 is received in the spring-receiving notch, the walls of which hold spring member 22 in the desired first equilibrium position. The cap attachment means, such as a screw, rivet 47 or the like, fixedly attach spring-compressing cap 42 to outer upright surface 25 via cap attachment means-receiving structure as depicted in FIG. 8.

Slide member attachment means 24 may preferably be defined by a screw, rivet, or similar other type fastening structure and function to fixedly attach upright attachment end 28 to article-engaging upright 20 substantially as depicted in FIG. 8. It will be seen that in the preferred embodiment, an additional support member 40 may be installed into a support member-receiving groove formed in inner upright surface 26, which support member 40 has been illustrated and referenced in FIGS. 1, 8, and 9. It will be noted from an inspection of FIGS. 8 and 9 that support member 40 extends or protrudes from inferior upright surface 27 so as to receive upright attachment end 28 such that the medial most portion of inferior upright surface 27 is flush with or tangent to superior slide surface 30. Support member 40 is also preferably constructed from aluminum and provides stable, rigid attachment structure to which slide member attachment means 24 may be affixed. It is contemplated that support member 40 is preferably utilized as intermediate attachment structure between upright attachment end 28 and article-engaging upright 20 so as to withstand moment forces directed against article-engaging upright. When attached to article-engaging upright 20, slide member 21 is preferably substantially orthogonal to article-engaging upright 20 as generally depicted in FIGS. 1 and 8.

Spring member attachment means 23 may preferably be defined by a hitch pin clip, which hitch pin clip comprises a substantially linear hitch pin portion and a zigzagged or substantially S-shaped hitch pin portion as both most clearly depicted in FIG. 8. It will be seen from an inspection of the noted figure that the linear hitch pin portion is received in a hitch pin-receiving bore formed in inferior upright surface 27 intermediate inner upright surface 26 and outer upright surface 25. When the linear hitch pin portion is inserted in the hitch pin-receiving bore, the linear hitch pin portion is substantially parallel to the planar inner and outer upright surfaces 25 and 26. The zigzagged hitch pin portion thus imparts a compressive force against V-shaped spring member 22 to hold the same in pivotal contact with outer upright surface 25 substantially as depicted in FIG. 8. It is contemplated that by using a hitch pin substantially as depicted, V-shaped spring member 22 is structurally less confined and allowed to compress and expand more freely. Further, V-shaped spring member 22 is allowed to slightly pivot about the contact point of the hitch pin and outer upright surface 25 such as when slide support assembly 12 is inserted into assembly-receiving slot 15. The structural ability to slightly pivot allows spring member 22 to be more readily received by assembly-receiving slot 15.

Further, it will be seen from an inspection of FIG. 8 that inferior spring region 36 is received in spring member-receiving groove 32 when spring member 22 is pivotally engaged with article-engaging upright 20. Spring member-receiving groove 32 effectively allows the wing termini or spring ends to be displaced from the first equilibrium position to additional equilibrium positions. In other words, spring wings 34 are free to be compressed and expanded adjacent the substantially planar surface of spring member-receiving groove 32. Notably, spring wings 34 extend toward slide surface end 29, which feature particularly distinguishes the present invention over the prior art. This feature is discussed in more hereinafter.

The substantially planar select support structure is preferably positioned opposite inner upright surface 26 in substantially parallel relation thereto. The select support structure is preferably selected from the group consisting of a user-selected wall 41 as generally illustrated and referenced in FIGS. 10–12, and a second slide support assembly 12 as generally depicted in FIGS. 1 and 10, and 12. In other words, the user may elect to either use a stationary support surface or wall 41 as generally depicted in FIGS. 10–12 or the user may elect to utilize a movable support surface or wall (inner upright surface 26) as embodied in a second slide support assembly 12. The second slide assembly 12 when utilized as a component of article stowage system 10 is structurally identical to the first slide assembly 12 and positioned in assembly-receiving slot such that inner upright surfaces 26 of the first and second slide support assemblies 12 oppose one another for stowing articles therebetween.

As earlier indicated, slide member 21 is received in slide member-receiving slot 15. In the preferred embodiment, superior slot surfaces 18 are substantially tangent to the rounded superior slide surface 30 an in low friction, slidable contact therewith. Further, inferior slot surface 17 is preferably in slidable or low frictional contact with inferior slide surface 31. The wing termini (in the second equilibrium position) are also in frictional contact with spring member-engaging surfaces 16 under expansive forces as spring member 22 tends to the first equilibrium position.

The second equilibrium position of spring member 22 may preferably be defined by the "second distance" (the distance between wing termini) when slide support assembly 12 is inserted into assembly-receiving slot 15. The "second distance" is thus preferably substantially equal in magnitude to the "first distance" (the distance between spring member-engaging surfaces 16). Thus, the wing termini or spring ends of spring member 22 when in the second equilibrium position are in an intermediate compressed state. In other words, as earlier specified, when slide support assembly 12 is inserted into assembly-receiving slot 15, the wing termini or spring ends of spring member 22 are in an intermediate compressed state defined as the second equilibrium position. The wing termini or spring ends thus make forceful contact with spring member-engaging surfaces 16 under the expansive forces of spring member 22 as spring member 22 attempts to return to the first equilibrium position. It will thus be understood that the "second distance" is substantially equal in magnitude to the "first distance" when spring member 22 is in the second equilibrium position. Further, it will be seen that the wing termini or spring ends are in unidirectional or frictional contact with spring member-engaging surfaces 16.

Notably, inferior upright surface 27 is preferably slidably engaged with upright-engaging surface 13 and spring member 22 thus only allows unidirectional movement or unidirectional translation of each slide support assembly 12 when the slide support assemblies are inserted in assembly-receiving slot 15. In other words, spring member 22 when so specified and place in pivotal contact with article-engaging upright 20, allows a first slide support assembly 12 to translate toward the select support structure (user-selected wall 41 or a second slide support assembly 12) under the action of a first friction-overcoming force directed toward the select support structure, which first friction-overcoming force has a component directed orthogonally to outer upright surface 25. It will be further understood that spring member 22 when so specified prevents the first slide support assembly 12 from translating toward slide surface end 29 given a load force (originating from stowed articles, for example) directed toward slide surface end 29 orthogonal to inner upright surface 25 as generally depicted at 46 in FIG. 5. Thus, it will be understood that the pointed wing termini or spring ends enhance unidirectional contact with spring member-engaging surfaces 16.

It will thus be understood that while the '897 patent teaches spring like means for selectively placing the book end uprights in locked engagement with a book end-receiving slot, the terminal ends of the spring like means as taught by the '897 patent are oriented parallel to the slot track or groove. It is contemplated that given sufficient load force directed against the book end upright from the stowed article direction, that static (and kinetic) frictional forces between the slot walls and outwardly bent flanges "c" and "c" may be overcome, thus causing outwardly bent flanges "c" and "c" to accelerate in the direction of the friction-overcoming force. The present invention provides a slide support assembly comprising a V-shaped spring member, which terminal ends are orthogonally oriented relative to the slot track or groove so that when load forces are directed against the upright member from the direction of the stowed articles, the terminal spring ends, under expansive force of the spring member, become lodged or embedded in the side walls (as the load force drives the terminal spring ends into the side walls) of the track or groove for preventing linear acceleration along the groove or slotted track.

However, as generally depicted in FIG. 3, spring wings 34 are each preferably compressible to a third equilibrium position for eliminating frictional or lodged contact between the wing termini and spring member-engaging surfaces 16 to allow bidirectional movement or bidirectional translation of each slide support assembly 12 in assembly-receiving slot 15. In other words, if the user manually compresses spring wings 34 to a third equilibrium position defined by a most compressed state (or the second distance having a magnitude less than the first distance), only slidable, low friction contact between assembly-receiving slot 15 and slide member 21 will remain, thus allowing the user to freely to translate the selected slide support assembly bidirectionally in assembly-receiving slot 15. Restated, the user, when compressing spring member 22 to the third equilibrium position may translate a given slide support assembly 12 toward the respective slide surface end 29 by providing a second friction-overcoming force directed toward slide surface end 29 orthogonal to inner upright surface 26. Thus, article stowage system 10 effectively enables a user to stow articles adjacent slide support assembly-receiving base 11 intermediate the select support structure and inner upright surface 26.

Each slide support assembly 12 may preferably comprise a pliable spring member jacket 43 as illustrated and referenced in FIGS. 1, 10, and 11. It is contemplated that the manual compression of spring member 22 may often result in some degree of discomfort to the user since one's fingers would typically be used to compress spring member 22 substantially is depicted in FIG. 3. It will be recalled that the wing termini or spring ends are preferably sharpened or pointed. Given that the required compressive force to place spring member 22 in the third equilibrium position will be substantially uniform over time, it is contemplated that by increasing the surface contact area between the pointed wing termini and one's fingers, one may effectively reduce the pressure one would otherwise experience as spring member 22 is compressed to the third equilibrium position. Thus, it is contemplated that spring member jacket 43 may preferably be fastened about superior spring region 35 so as to increase the contact area between the wing termini and compressive forces applied thereto, thereby relieving or decreasing pressure. It will be noted that pressure is directly related to the compressive force and inversely related to the contact surface area, which may be summarized according to the following mathematical relationship:

$$\text{Pressure } (P) = \text{Force } (F) \div \text{Area } (A).$$

Preferably, superior slot surfaces 18, inferior slot surface 17, superior slide surface 30, and inferior slide surface 31 are polished or made smooth so as to reduce the coefficients of static and kinetic friction between opposing contacting surfaces. By polishing the noted surfaces, the user may more easily (with less force) direct either slide support assembly 12 in assembly-receiving slot 15. It will thus be noted that the described surfaces are preferably smooth. In contrast, it is preferable that spring member-engaging surfaces 16 are unpolished or left rough (as exaggerated in FIG. 3) so as to effectively increase the coefficients of static and kinetic friction and retard unidirectional translation of each slide support assembly 12 in assembly-receiving slot 15. As was earlier noted, the wing termini are preferably pointed for increasing the frictional contact with spring member-engaging surfaces 16 and improving the unidirectional characteristics of the present invention when spring member is in the second equilibrium position.

While the above description contains much specificity, this specificity should not be construed as limitations on the scope of the invention, but rather as an exemplification of the invention. For example, the slide support assembly-receiving means need not comprise a support-engaging surface. So long as the slide support assembly-receiving means essentially comprises a slide member-receiving slot or slide support assembly-receiving slot 15, it is contemplated that the necessary structure is present. In this regard, it is contemplated that assembly-receiving slot 15 may be formed substantially as earlier described directly in a surface material at the desired site of article stowage assembly 10. However, it is contemplated that routing out a separate piece of stock material and attaching the slotted slide support assembly-receiving base to a select support structure or surface is easier (and less costly) to practice. The slotted assembly-receiving base may then be attached to cabinetry or other similar support site as elected by the user. In sum, the slide support assembly-receiving means essentially comprises a slide support assembly-receiving slot comprising two opposite, substantially parallel spring member-engaging surfaces, and a slide member-receiving portion. The slide member-receiving portion is preferably formed adjacent the spring member-engaging surfaces, and necessarily comprises a slide member-engaging surface or slot surface extending from the first spring member engaging surface to the second sprig member-engaging surface. In this last regard, it should be further noted that the slide member-receiving portion need not comprise a dovetail or wedge-shaped cross section, but may comprise a somewhat T-shaped cross section or other functional cross section.

Further, each slide support assembly necessarily comprises an article-engaging upright, a slide member, a spring member, and component attachment means. It is thus contemplated that the spirit of the present invention is practiced provided the noted components are structurally defined and related as per the following description. The article-engaging upright essentially comprises an outer upright surface and an inner upright surface. The slide member essentially comprises an upright attachment end, a slide surface end, and a slide surface. The spring member essentially comprises first and second spring ends and a spring body intermediate the first and second spring ends. The component attachment means function (1) to attach the upright attachment end to the article-engaging upright and (2) to place the spring body in contact with the outer upright surface such that the spring member is spatially oriented in superior adjacency to the slide surface. The slide member may thus be receivable in a slide member-receiving slot, the slot surface slidably contacting the slide surface, and the spring ends contacting the spring member-engaging surfaces for allowing the slide support assembly to translate unidirectionally. Notably, the spring member is further compressible for eliminating contact between the spring ends and the spring member-engaging surfaces to allow the slide support assembly to translate bidirectionally. In other words, the spring ends, being orthogonal to the assembly-receiving means, are cooperatively associated with the spring member-engaging surfaces for allowing the slide support assembly to translate in a select direction directional movement, the select directional movement being selected from the group consisting of unidirectional movement and bidirectional movement as respectively and structurally allowed by the second and third equilibrium positions.

Further, the spring member attachment means need not be defined by a hitch pin as described and specified hereinabove. It is contemplated that screws or similar other type fastening structure may function to place vertex region 33 in contact with outer upright surface 25. Excellent results have been obtained, however, when the spring member attachment means are defined by a hitch pin substantially as earlier specified to allow pivotal contact between the spring member and the outer upright surface.

Accordingly, although the invention has been described by reference to a preferred embodiment, it is not intended that the novel assembly be limited thereby, but that modifications thereof are intended to be included as falling within the broad scope and spirit of the foregoing disclosure, the following claims and the appended drawings.

I claim:

1. An article stowage system for stowing substantially flat articles in vertically juxtaposed relation, the flat article stowage system comprising, in combination:

a slide support assembly-receiving base, the slide support assembly-receiving base comprising an upright-engaging surface, a support-engaging surface, and a substantially linear assembly-receiving slot, the assembly-receiving slot being formed intermediate the upright-engaging surface and the support-engaging surface, the assembly-receiving slot comprising two opposite, substantially parallel spring member-engaging surfaces and a slide member-receiving portion, the slide member-receiving portion being formed intermediate the spring member-engaging surfaces and the support-engaging surface, the spring member-engaging surfaces having a first distance therebetween, the slide member-receiving portion comprising a wedge-shaped cross section, the slide member-receiving portion thus comprising a substantially planar inferior slot surface and two opposite, superior slot surfaces angled from the inferior slot surface to the spring member-engaging surfaces;

a first slide support assembly, the slide support assembly comprising a substantially planar article-engaging upright, a substantially linear slide member, a substantially V-shaped spring member, spring member attaching means, and slide member attaching means, the article-engaging upright comprising an outer upright surface, an inner upright surface, and an inferior upright surface, the slide member comprising an upright attachment end, a slide surface end, a rounded superior slide surface, a substantially planar inferior slide surface, and a spring member-receiving groove intermediate the upright attachment end and the slide surface end, the V-shaped spring member comprising a vertex region, two opposite spring wings, a superior spring region, and an inferior spring region, each spring wing comprising a wing terminus, the wing termini having a second distance therebetween when the spring member is in a first equilibrium position, the first equilibrium position defined by the second distance having greater magnitude than the first distance, the slide member attaching means fixedly attaching the upright attachment end to the article-engaging upright, the slide member being substantially orthogonal to the article-engaging upright, the spring member attaching means pivotally attaching the vortex region to the outer upright surface, the inferior spring region received in the spring member-receiving groove, the spring wings extending toward the slide surface end, the wing termini being orthogonal to the upright-engaging surface; and a substantially planar select support structure, the select support structure being positioned opposite the inner upright surface in substantially parallel relation thereto, the slide member being received in the slide member-receiving portion, the superior slot surfaces being substantially tangent to the superior-slide surface, the inferior slot surface being in slidable contact with the inferior slide surface, the wing termini being in unidirectional contact with the spring member-engaging surfaces when in a second equilibrium position, the second equilibrium position defined by the second distance having substantially equal magnitude as the first distance, the inferior upright surface slidably engaged with the upright-engaging surface, the spring member thus allowing the slide support assembly to translate toward the select support structure given a first friction-overcoming force directed toward the select support structure orthogonal to the outer upright surface, the spring member thus preventing the slide support assembly to translate toward the slide surface end given a load force directed toward the slide surface end orthogonal to the inner upright surface, the spring wings being compressible to a third equilibrium position for eliminating unidirectional contact between the wing termini and the spring member-engaging surfaces to allow the slide support assembly to translate toward the slide surface end given a second friction-overcoming force directed toward the slide surface end orthogonal to the inner upright surface, the third equilibrium position defined by the second distance having a magnitude less than the first distance, the article support system thus enabling a user to stow articles adjacent the slide support assembly-receiving base intermediate the select support structure and the inner upright surface.

2. The article stowage system of claim 1 wherein the spring member attaching means is defined by a hitch pin clip.

3. The article stowage system of claim 1 wherein the select support structure is selected from the group consisting of a user-selected wall and a second slide support assembly, the second slide assembly being structurally identical to the first slide assembly and positioned such that the inner upright surfaces oppose one another for stowing articles therebetween.

4. The article stowage system of claim 3 wherein at least one slide support assembly comprises spring member compressing means, the spring member compressing means for maintaining the spring member in the first equilibrium position.

5. The article stowage system of claim 4 wherein the spring member compressing means are defined by a spring-compressing cap, the spring-compressing cap comprising a spring-receiving notch and cap attaching means, the spring-receiving notch being defined by opposite notch walls, the notch walls for retaining the spring member in the first equilibrium position, the superior spring region being received in the spring-receiving notch, the cap attaching means fixedly attaching the spring-compressing cap to the outer upright surface.

6. The article stowage system of claim 3 wherein at least one slide support assembly comprises a pliable spring member jacket, the spring member jacket being fastened about the superior spring region for increasing contact area between the wing termini and compressive forces applied thereto.

7. The article stowage system of claim 1 wherein the superior slot surfaces, the inferior slot surface, the superior slide surface, and the inferior slide surface are polished for reducing friction, the spring member-engaging surfaces are unpolished for increasing friction, and the wing termini are pointed for enhancing unidirectional contact with the spring member-engaging surfaces.

8. An article stowage system for stowing substantially flat articles in juxtaposed relation, the article stowage system comprising, in combination:

slide support assembly-receiving means, the support assembly-receiving means comprising a substantially planar upright-engaging surface and a substantially linear slide support assembly-receiving slot, the slide support assembly-receiving slot being formed adjacent the upright-engaging surface, the slide support assembly-receiving slot comprising first and second substantially parallel spring member-engaging surfaces and a slide member-receiving portion, the slide member-receiving portion being formed adjacent the spring member-engaging surfaces, the spring member-engaging surfaces having a first distance therebetween, the slide member-receiving portion comprising a slot surface extending from the first spring member-engaging surface to the second spring member-engaging surface; and first and second slide support assemblies, each slide support assembly comprising a substantially planar article-engaging upright, a substantially linear slide member, a substantially V-shaped spring member, spring member attaching means, and slide member attaching means, the article-engaging uprights each comprising an outer upright surface, an inner upright surface, and an inferior upright surface, the slide members each comprising an upright attachment end, a slide surface end, a slide surface, and a spring member-receiving groove intermediate the upright attachment end and the slide surface end, the V-shaped spring members each comprising a vertex region, two opposite spring wings, a superior spring region, and an inferior spring region, each spring wing comprising a wing terminus, the wing termini having a substantially uniform second distance therebetween when the spring members are each in a first equilibrium position, the first equilibrium position being defined by the second distance having greater magnitude than the first distance, the slide member attaching means fixedly attaching the upright attachment ends to the article-engaging uprights, the slide members being substantially orthogonal to the article-engaging uprights, the spring member attaching means pivotally attaching the vertex regions to the outer upright surfaces, the inferior spring regions received in the spring member-receiving grooves, the spring wings extending toward the slide surface ends, the wing termini being orthogonal to the upright-engaging surface, the slide members each being received in the slide member-receiving portion, the inner upright surfaces being opposite one another, the slot surface being in slidable contact with the slide surfaces, the wing termini being in unidirectional contact with the spring member-engaging surfaces when in a second equilibrium position, the second equilibrium position defined by the second distance having substantially equal magnitude as the first distance, the inferior upright surfaces slidably engaged with the upright-engaging surface, the spring members thus allowing the slide support assemblies to translate toward one another and preventing the slide support assemblies to translate away from one another, the spring wings being compressible to a third equilibrium position for eliminating unidirectional contact between the wing termini and the spring member-engaging surfaces, the third equilibrium position defined by the second distance having a magnitude less than the first distance, the third equilibrium position thus allowing the slide support assemblies to translate away from one another, the article stowage system thus enabling a user to stow articles adjacent the slide support assembly-receiving means intermediate the inner upright surfaces.

9. The article stowage system of claim 8 wherein the slide support assemblies each comprise spring member compressing means, the spring member compressing means for maintaining the spring members in the first equilibrium position.

10. The article stowage system of claim 9 wherein the spring member compressing means are defined by a spring-compressing cap, the spring-compression caps comprising a spring-receiving notch and cap attaching means, the spring-receiving notches each being defined by opposite notch walls, the notch walls for retaining the spring members in the first equilibrium position, the superior spring regions being received in the spring-receiving notches, the cap attaching means fixedly attaching the spring-compressing caps to the outer upright surfaces.

11. The article stowage system of claim 8 wherein the slide support assemblies each comprise a pliable spring member jacket, the spring member jackets being fastened about the superior spring regions for increasing contact area between the wing termini and compressive forces applied thereto.

12. The article stowage system of claim 8 wherein the slot surface and the slide surface are polished for reducing friction, the spring member-engaging surfaces are unpolished for increasing friction, and the wing termini are pointed for enhancing unidirectional contact with the spring member-engaging surfaces.

13. An article stowage system, the article stowage system for stowing articles in juxtaposed relation, the article stowage system comprising:

substantially planar assembly-receiving means, the assembly-receiving means comprising a slide member-receiving slot, the slide member-receiving slot comprising first and second substantially parallel spring member-engaging surfaces and a slide member-receiving portion, the slide member-receiving portion being formed adjacent the spring member-engaging surfaces, the slide member-receiving portion comprising a slide member-engaging surface extending from the first spring member-engaging surface to the second spring member-engaging surface; and at least one slide support assembly, the slide support assembly comprising an article-engaging upright, a slide member, a spring member, and component attaching means, the article-engaging upright comprising an outer upright surface and an inner upright surface, the slide member comprising an upright attachment end, a slide surface end, and a slide surface, the spring member comprising first and second spring ends and a spring body intermediate the first and second spring ends, the spring ends being substantially orthogonal to the assembly-receiving means, the component attaching means attaching the upright attachment end to the article-engaging upright and the spring body to the outer upright surface, the slide member being received in the slide member-receiving portion, the slide member-engaging surface slidably contacting the slide surface, the spring ends being cooperatively associated with the spring member-engaging surfaces for allowing the slide support assembly to translate in select directional movement.

14. The article stowage system of claim 13 wherein the select directional movement is selected from the group consisting of unidirectional movement and bidirectional movement.

15. The article stowage system of claim 14 wherein the select support structure is selected from the group consisting of a user-selected wall and a second slide support assembly, the second slide assembly being structurally identical to the first slide assembly and positioned such that the inner upright surfaces oppose one another for stowing articles therebetween.

16. The article stowage system of claim 15 wherein the spring member compressing means are defined by a spring-compressing cap, the spring-compression cap comprising a spring-receiving notch, the spring-receiving notch being defined by opposite notch walls, the notch walls for retaining the spring member in the first equilibrium position, the superior spring region being received in the spring-receiving notch, the component attaching means fixedly attaching the spring-compressing cap to the outer upright surface.

17. The article stowage system of claim 13 where in the article stowage system comprises a substantially planar select support structure, the select support structure being positioned opposite the inner upright surface in substantially parallel relation thereto, the article support system thus enabling a user to stow articles adjacent the slide support assembly-receiving means intermediate the select support structure and the inner upright surface.

18. The article stowage system of claim 17 wherein at least one slide support assembly comprises spring member compressing means, the spring member compressing means for maintaining the spring member in a first equilibrium position.

19. The article stowage system of claim 17 wherein at least one slide support assembly comprises a pliable spring member jacket, the spring member jacket being fastened about the superior spring region for increasing contact area between the spring ends and compressive forces applied thereto.

20. The article stowage system of claim 13 wherein the slide member-engaging surface and the slide surface are polished and the spring member-engaging surfaces are unpolished.

21. The article stowage system of claim 13 wherein the spring ends are each pointed for enhancing unidirectional contact with the spring member-engaging surfaces.

* * * * *